US006439406B1

(12) United States Patent
Duhon

(10) Patent No.: US 6,439,406 B1
(45) Date of Patent: Aug. 27, 2002

(54) CAROUSEL DEVICE FOR STORING MEDICATION CONTAINERS

(76) Inventor: Mary Didier Duhon, 22115 E. Roselake, Tomball, TX (US) 77375

( * ) Notice: Subject to any disclaimer, the term of this patent is extended or adjusted under 35 U.S.C. 154(b) by 0 days.

(21) Appl. No.: 09/713,491

(22) Filed: Nov. 15, 2000

(51) Int. Cl.[7] ..... A47F 3/14; A47B 47/00

(52) U.S. Cl. ..... 211/131.1; 211/77; 211/163; 211/194

(58) Field of Search ..... 211/131.1, 163, 211/77, 78, 194, 184, 166, 126.2, 126.4, 126.7, 126.12; 312/202, 248, 252, 299, 291, 305, 326; 108/94, 20, 11

(56) References Cited

U.S. PATENT DOCUMENTS

| | | | | | |
|---|---|---|---|---|---|
| 922,888 | A | * | 5/1909 | Grunwaldt | |
| 2,118,444 | A | * | 5/1938 | Mueller | |
| 2,308,629 | A | * | 1/1943 | Rosenberg | |
| 2,327,742 | A | * | 8/1943 | Rosenberg | |
| 2,946,456 | A | * | 7/1960 | Liguori | |
| 3,693,807 | A | * | 9/1972 | Larson | 211/163 |
| 3,698,779 | A | * | 10/1972 | Holmes et al. | |
| 4,014,437 | A | * | 3/1977 | Rumble et al. | 211/78 |
| 4,030,608 | A | * | 6/1977 | Howard | 211/131.1 |
| 4,216,867 | A | * | 8/1980 | Sturm | 211/131.1 |
| 4,269,124 | A | * | 5/1981 | Rosenthal et al. | 211/163 |
| 4,453,326 | A | * | 6/1984 | Hoffman et al. | 211/131.1 |
| 4,549,664 | A | * | 10/1985 | Gowan et al. | 211/131.1 |
| 4,700,850 | A | * | 10/1987 | Morgan et al. | 211/131.1 |
| 4,736,856 | A | * | 4/1988 | Alneng et al. | 211/131.1 |
| 4,757,769 | A | * | 7/1988 | Suttles | 211/188 |
| 4,775,055 | A | | 10/1988 | Morse | |
| 4,796,960 | A | | 1/1989 | Candelas | |
| 4,895,260 | A | | 1/1990 | Arcona | |
| 4,953,696 | A | * | 9/1990 | Huang et al. | 206/214 |
| 4,964,520 | A | * | 10/1990 | Kilmartin, III | 211/131.1 |
| 5,024,168 | A | | 6/1991 | Stravitz | |
| 5,031,779 | A | * | 7/1991 | Szenay et al. | 211/163 |
| 5,033,626 | A | * | 7/1991 | Platti | 211/37 |
| 5,176,264 | A | * | 1/1993 | De Palma | 211/163 |
| 5,379,885 | A | * | 1/1995 | Chen | 206/216 |
| 5,524,775 | A | * | 6/1996 | Kaine | 211/131.1 |
| 5,564,578 | A | * | 10/1996 | Smith | 211/133 |
| 6,016,927 | A | * | 1/2000 | Krupp | 211/126.2 |
| 6,182,839 | B1 | * | 2/2001 | Robbins et al. | 211/78 |
| 6,189,710 | B1 | * | 2/2001 | Mason | 211/131.1 |
| 6,206,493 | B1 | * | 3/2001 | Sanchez-Levin et al. | 312/125 |

* cited by examiner

*Primary Examiner*—Daniel P. Stodola
*Assistant Examiner*—Jennifer E. Novosad
(74) *Attorney, Agent, or Firm*—Mary J. Gaskin

(57) ABSTRACT

A storage device for holding a plurality of medication containers. The device is a rotatable, multiple-tiered unit with adjustable storage compartments, formed with both permanent and temporary vertical dividers. Any number of tiers can be stacked atop each other and interlocked. A handle can be attached to make the unit portable.

6 Claims, 9 Drawing Sheets

CAROUSEL DEVICE FOR STORING MEDICATION CONTAINERS

BACKGROUND OF THE INVENTION

The present invention relates to a carousel device with a variable number of interlocking tiers, each of which can be partitioned vertically to store the desired size and number of prescription medication bottles.

Carousel devices are known in the art for storing spices, tapes, and other objects. However, none of the existing devices are adaptable to accommodate the many different-sized medication bottles which must be stored in a school clinic.

Hardware storage cabinets have been tried; however, bottles cannot be organized alphabetically by child's name or by time-of-day to be dispensed. Another common method of organization is to place each bottle in a plastic bag and file it in a file divider labeled with each child's name. However, that method works for paper files, not odd-shaped medicine containers. The method also consumes time in removing the bottles from and replacing them in the plastic bags. Other storage systems use rectangular drawers. However, these cannot accommodate large-diameter pill bottles.

School clinics need to have a storage system for prescription medicine containers which facilitates safe handling of medicine in an efficient manner.

SUMMARY OF THE INVENTION

The present invention relates to a compact, adaptable, versatile device for the storage of prescription pill bottles. The device is compact enough to fit in limited clinic space; adaptable enough to accommodate the different-sized medication bottles brought to the school clinic; and versatile enough to adjust to daily changes in medication needs.

The storage device is a cylindrical or cube-shaped, rotatable, multiple-tiered unit with adjustable storage compartments. The base, which may be separate from the bottom tier, contains the mechanism allowing the unit to rotate, using a principal similar to that of a lazy susan, or turntable.

Each tier may be interlocked with identical tiers in order to stack them, one atop another. Each tier consists of a horizontal plate with permanent vertical dividers of equal height disposed perpendicular to the plane of the plate and radial to the center. Each divider is high enough to allow most standard prescription pill bottles to be stored on their sides. Each tier has matching radial grooves cut into the top and the bottom surfaces of each plate. When the plates are arranged for stacking, the grooves of two adjacent plates are lined up. Edges of temporary dividers may be inserted into the grooves in order to form separate, wedge-shaped compartments.

The top tier of the unit consists of a flat plate with a shallow ledge around its circumference. Its underside has radial grooves, and it also interlocks with the tier below it. This plate provides upright storage of large bottles, containing either pills or liquid medication, which cannot be stored in any of the compartmentalized tiers. The stacked tiers provide a basis for different organizational schemes, e.g., each tier can accommodate medications to be dispensed at a particular time.

An object of the present invention is to provide a device with adjustable, variable-sized storage compartments for storing prescription medication bottles.

Yet another object of the present invention is to provide a compact storage device for use in potentially-limited clinic space.

Still another object of the present invention is to provide a device versatile enough to store a large number of different-sized prescription medication bottles, some of which contain pills and some of which contain liquids.

A further object of the present invention is to provide a storage device which organizes prescription medication bottles so that a nurse can quickly and efficiently find the correct one to dispense medication.

An additional object of the present invention is to provide a rotatable storage device which makes access to each prescription bottle quick and easy.

Another object of the present invention is to provide a storage device which provides efficient, organized storage of medications which must be kept in their original drug store containers.

A still further object of the present invention is to provide a storage device of variable height to accommodate greater or fewer containers, depending on the clinic's needs.

BRIEF DESCRIPTION OF THE PREFERRED EMBODIMENT

Figure 1:
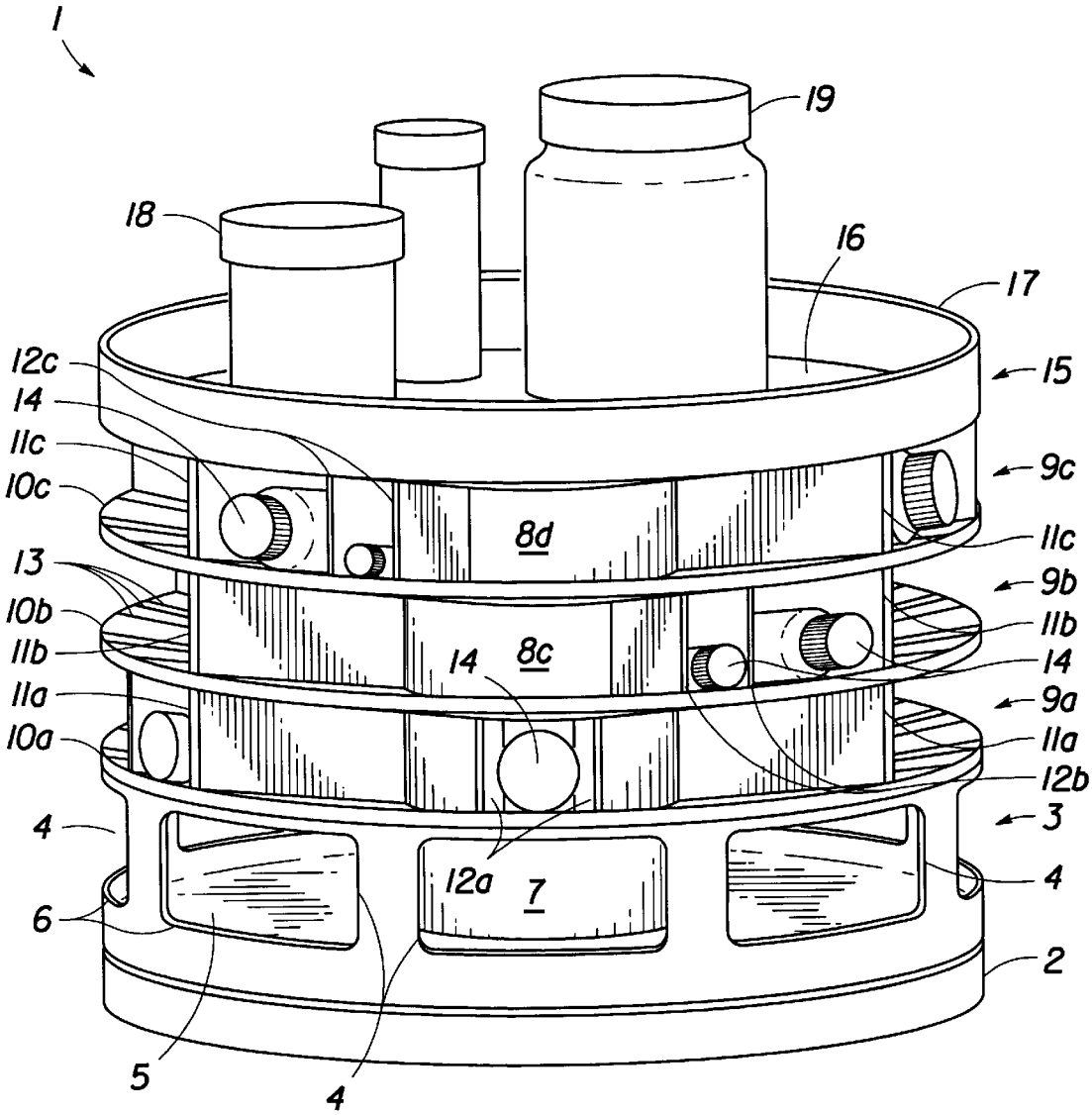
FIG. 1 is an isometric view of the storage device of the present invention having prescription medication bottles in accordance with the present invention.

The storage device 1 shown in FIG. 1 is generally constructed from molded plastic or fiberglass material. It can also be made from cast metal or pieces can be stamped out of metal. It has a base 2 with a mechanism which allows rotation so that all sides of the storage device 1 are readily accessible. An adapter 3, which may or may not be utilitarian, is attached to the base 2. If the adapter 3 is utilitarian, it will have openings 4 spaced around its circumference for placement of prescription medicine containers. The floor 5 of the adapter 3 is flat. To keep the containers from flying out when the storage device 1 is rotated, each opening 4 has a raised lower edge 6. At the central portion of the adapter 3 is a receiving cup 7 for alignment cylinder 8*a* (not visible), which extends downwardly from the central portion of first storage tier 9*a*. First storage tier 9*a* has a disk-shaped plate 10*a*, the surface of which is radially inclined downward from the horizontal at an angle of approximately 8° to 45°. Three radial vertical affixed dividers 11*a*, spaced 120° apart, provide support for the second storage tier 9*b*, as well as partial compartmentalization. Temporary dividers 12*a* can be slid into appropriate grooves 13 at varying intervals in order to create compartments for medication bottles 14. Second storage tier 9*a* is identical to first storage tier 9*a*, with a disk-shaped plate 10*b*, alignment cylinder 8*b*, vertical affixed dividers 11*b*, and temporary dividers 12*b*. Identical third storage tier 9*c* has a disk-shaped plate 10*c*, an alignment cylinder 8*c*, vertical affixed dividers 11*c*, and temporary dividers 12*c*. Additional identical tiers (not shown) can be added to the stack. The disk-shaped top tier 15 has a flat surface 16, a raised retaining rim 17 around its circumference, and an alignment cylinder 8*d*. Oversized medication containers 18 and liquid medicine bottles 19 can be stored upright on the top tier 15.

Figure 2:
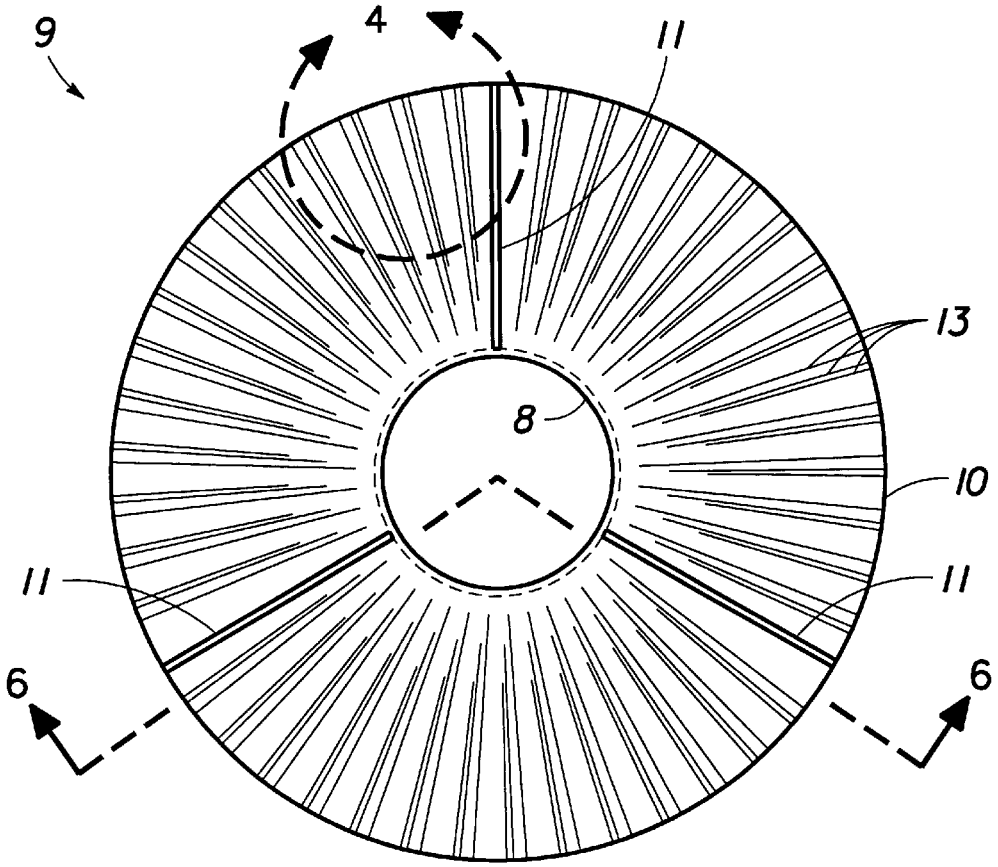
FIG. 2 is a top plan view of one of the tiers of the present invention.

FIG. 2 shows the upper surface of the plate 10 of any of the storage tiers 9, without any temporary dividers 12. The affixed dividers 11 are spaced 120° apart. The edges of temporary dividers 12 (not shown) can be slid into radial grooves 13, spaced at regular intervals, to make compartments for storing different-sized medication containers. At the center is alignment cylinder 8.

Figure 3:
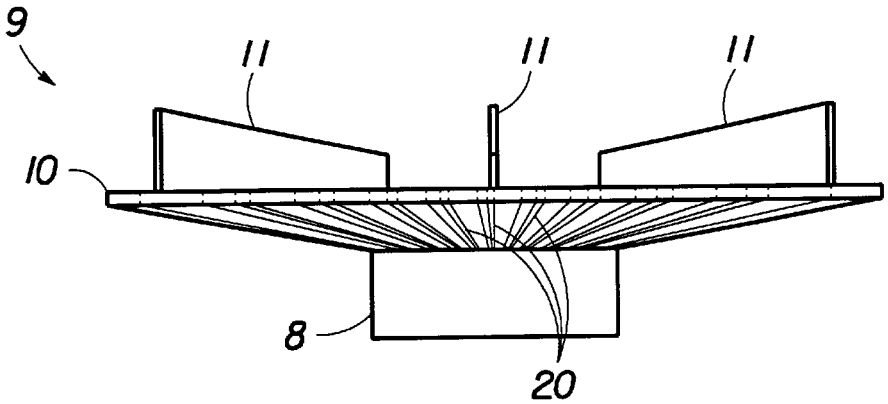
FIG. 3 is a side view of one of the tiers of the present invention.

FIG. 3 shows the matching radial grooves 20 on the bottom side of plate 10 of storage tier 9. The affixed dividers 11 can be seen, as well as the alignment cylinder 8, which extends downwardly from the central portion of the plate 10.

Figure 4:
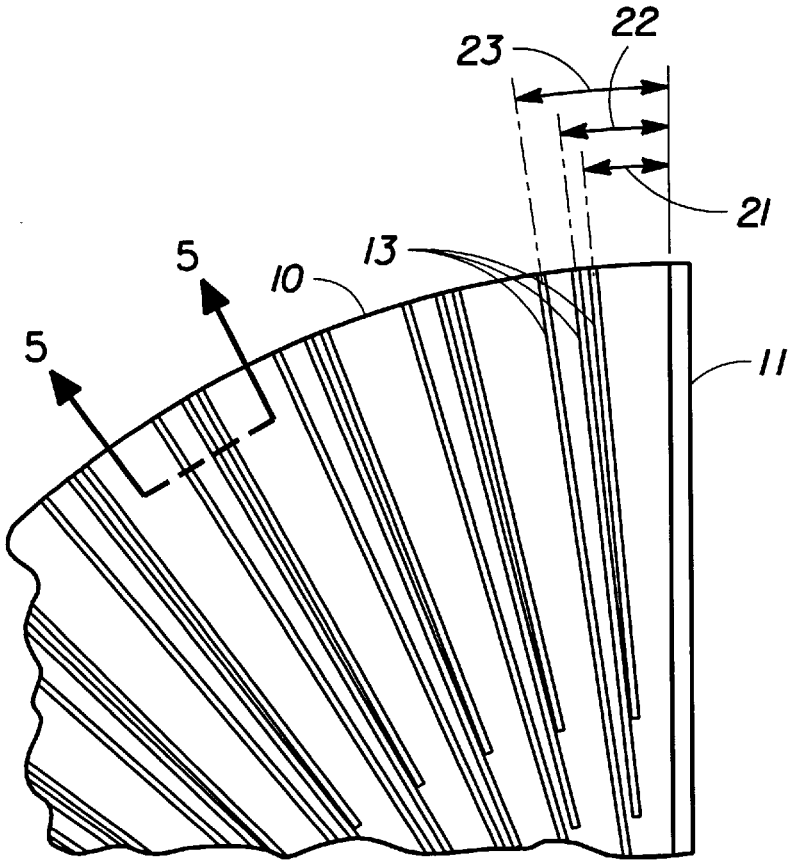
FIG. 4 is a sectional view of the top view of one of the tiers, showing the grooves.

In FIG. 4, a close-up of a portion of the surface of plate 10 shows the radial grooves 13, which accommodate temporary dividers (not shown). The grooves 13 are spaced at regular, repeating intervals on the surface of the plate 10, i.e., spaced at 5° (21), 6° (22) and 8°0 (23) from the affixed dividers 11. Matching grooves 20 are similarly spaced on the opposite surface of the plate 10.

Figure 5:
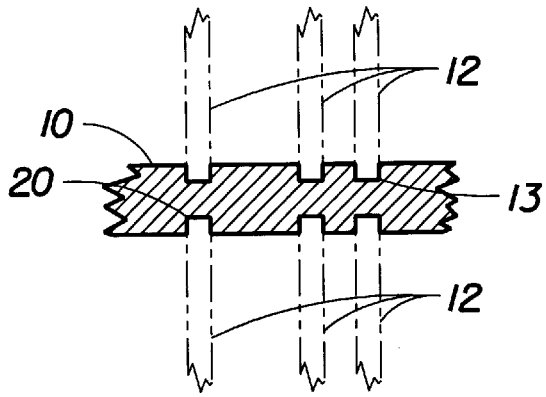
FIG. 5 is a cross-sectional detail of several of the grooves showing portions of the dividers inserted therein.

FIG. 5 shows a portion of the plate 10 in cross section, with the radial grooves 13 cut into the upper side of the plate 10, and matching grooves 20 cut into the lower side of the plate 10. Temporary dividers 12 have been inserted into both sets of grooves 13, 20.

Figure 6:
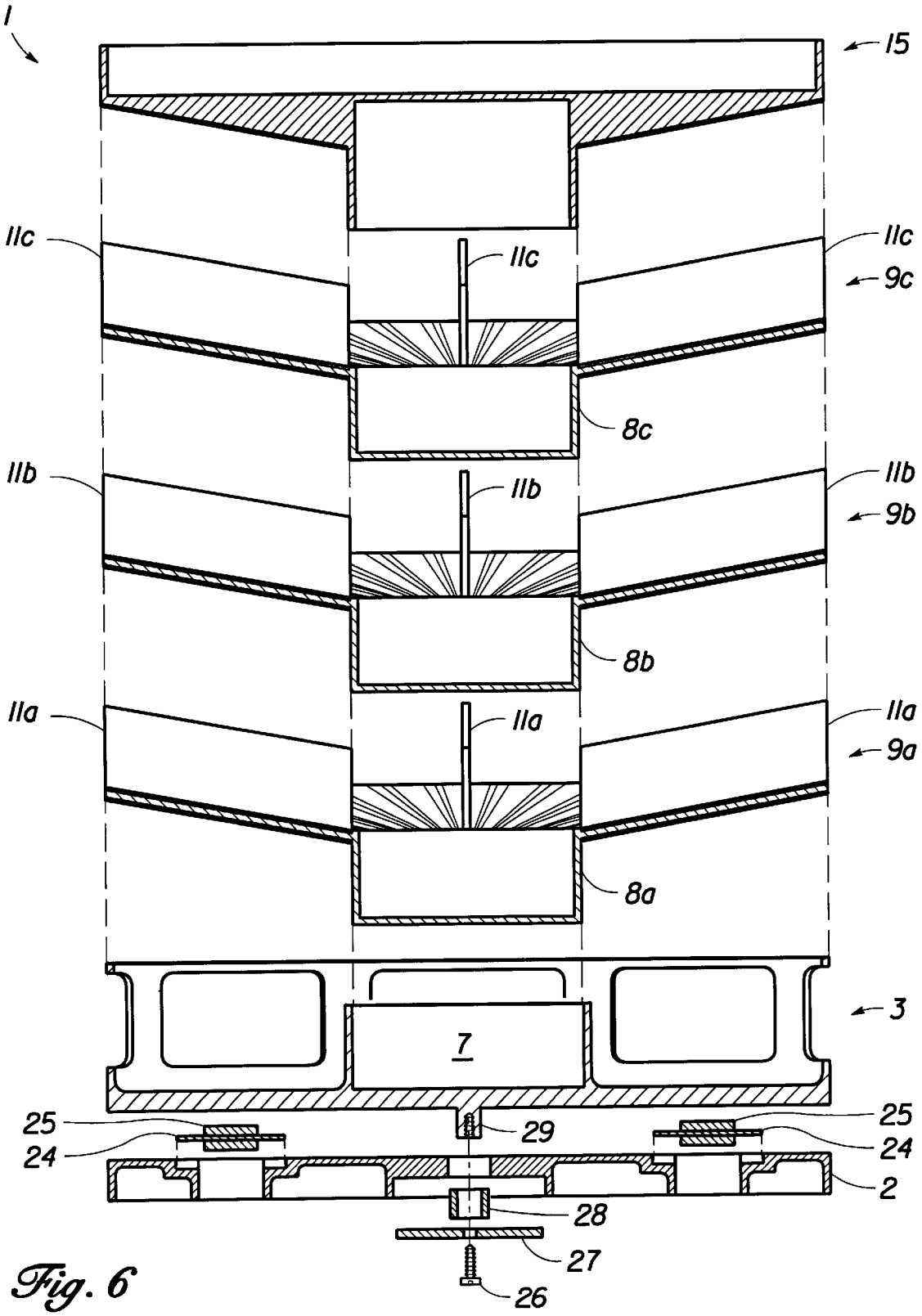
FIG. 6 is a exploded cross-sectional view of the storage device of the present invention.

The exploded sectional view of FIG. 6 shows 240° of the storage device 1. Pins 24 mount cylindrical rollers 25 to the top side of the base 2; the underside of adapter 3 moves freely over the rolling cylindrical rollers 25, allowing the adapter to rotate on the base 2. An alternate embodiment of the storage device can use ball bearings for rotation. The base 2 is attached to the adapter 3 by means of a screw 26, which is inserted through washer 27 and mounting cylinder 28 and screwed into a post 29 on the bottom of the adapter 3. Alignment cylinder 8*a*, which extends downwardly from the central portion of first storage tier 9*a*, fits into receiving cup 7 at the center of the adapter 3. Alignment cylinder 8*b*, which extends downwardly from the central portion of second storage tier 9*a*, when assembled, rests between and is kept axially aligned by vertical affixed dividers 11*a* of first storage tier 9*a*. Similarly, alignment cylinder 8*c* of third storage tier 9*c* is kept axially aligned by vertical affixed dividers 11*b* of second storage tier 9*a*. Finally, top tier 15 has an alignment cylinder 8*d*, which is kept axially aligned by vertical affixed dividers 11*c* of third storage tier 9*c*.

Figure 7:
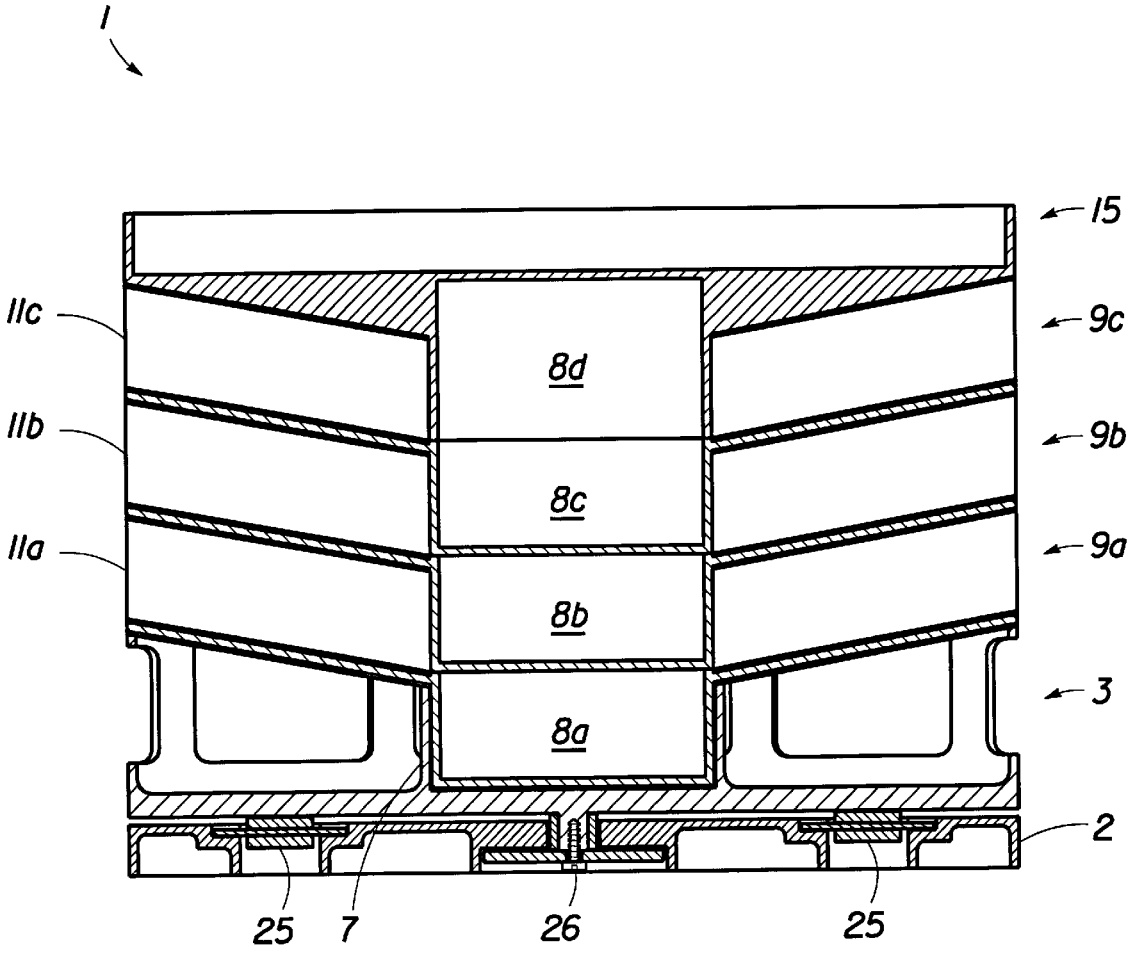
FIG. 7 is a cross-sectional elevation view of the assembled storage device.

The sectional view in FIG. 7 shows 240° of the assembled storage device 1. Mounted cylindrical rollers 25 allow adapter 3 to rotate on the base 2. The screw 26 attaches the base 2 to the adapter 3. Alignment cylinder 8*a* fits into receiving cup 7; alignment cylinder 8*b*, rests between and is kept axially aligned by vertical affixed dividers 11*a* of first storage tier 9*a*; alignment cylinder 8*c* of third storage tier 9*c* is kept axially aligned by vertical affixed dividers 11*b* of second storage tier 9*b*; alignment cylinder 8*d* of top tier 15 is kept axially aligned by vertical affixed dividers 11*c* of third storage tier 9*c*.

Nesting the storage tiers 9 in this fashion, without more, will provide a stable storage device 1. However, in order to make the storage device 1 portable, means of interlocking the different tiers may be provided.

Figure 8:
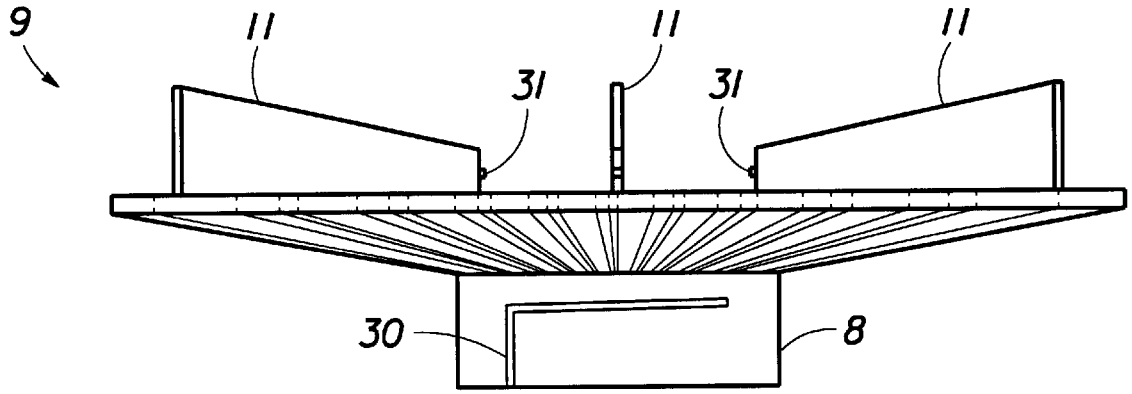
FIG. 8 is a side view of a circular tier, showing an L-shaped groove which can be used to interlock circular tiers.

For instance, as FIG. 8 shows, a sideways L-shaped groove 30 is cut into the outer circumference of the alignment cylinder 8 of each storage tier 9. Two additional identical grooves spaced 120° apart on the alignment cylinder 8, are not shown. A small boss 31 protrudes from the inner end of each affixed divider 11.

Figure 9:
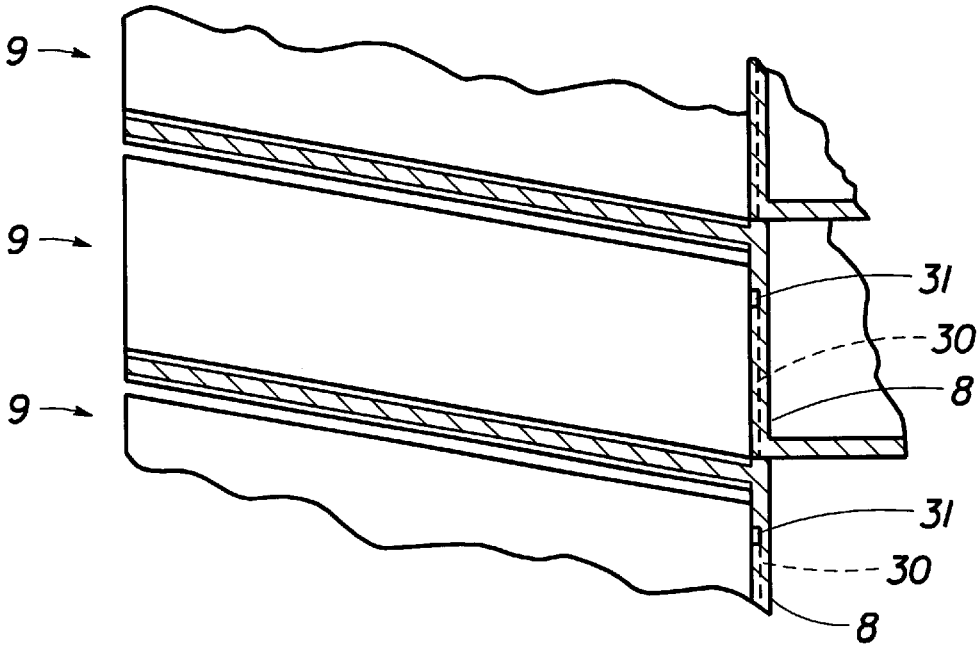
FIG. 9 is a cross-sectional detail showing the interlocking assembly.

As shown in FIG. 9, in assembling the storage device 1, the vertical portions of the three L-shaped grooves 30 are arranged over the bosses 31 on the three affixed dividers 11 of the storage tier 9 directly beneath. The alignment cylinder 8 is lowered until the horizontal portions of the three L-shaped grooves 30 are reached; then the storage tier 9 is rotated a quarter of a turn, sliding each boss 31 to the end of its groove 30. The movement locks one storage tier 9 to the storage tier 9 below.

Figure 11:
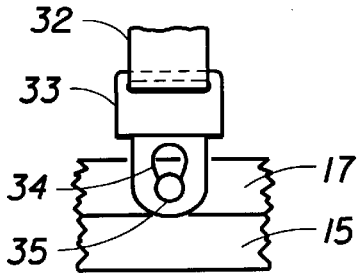
FIG. 11 is a detail showing the attachment point of the handle.
Figure 10:
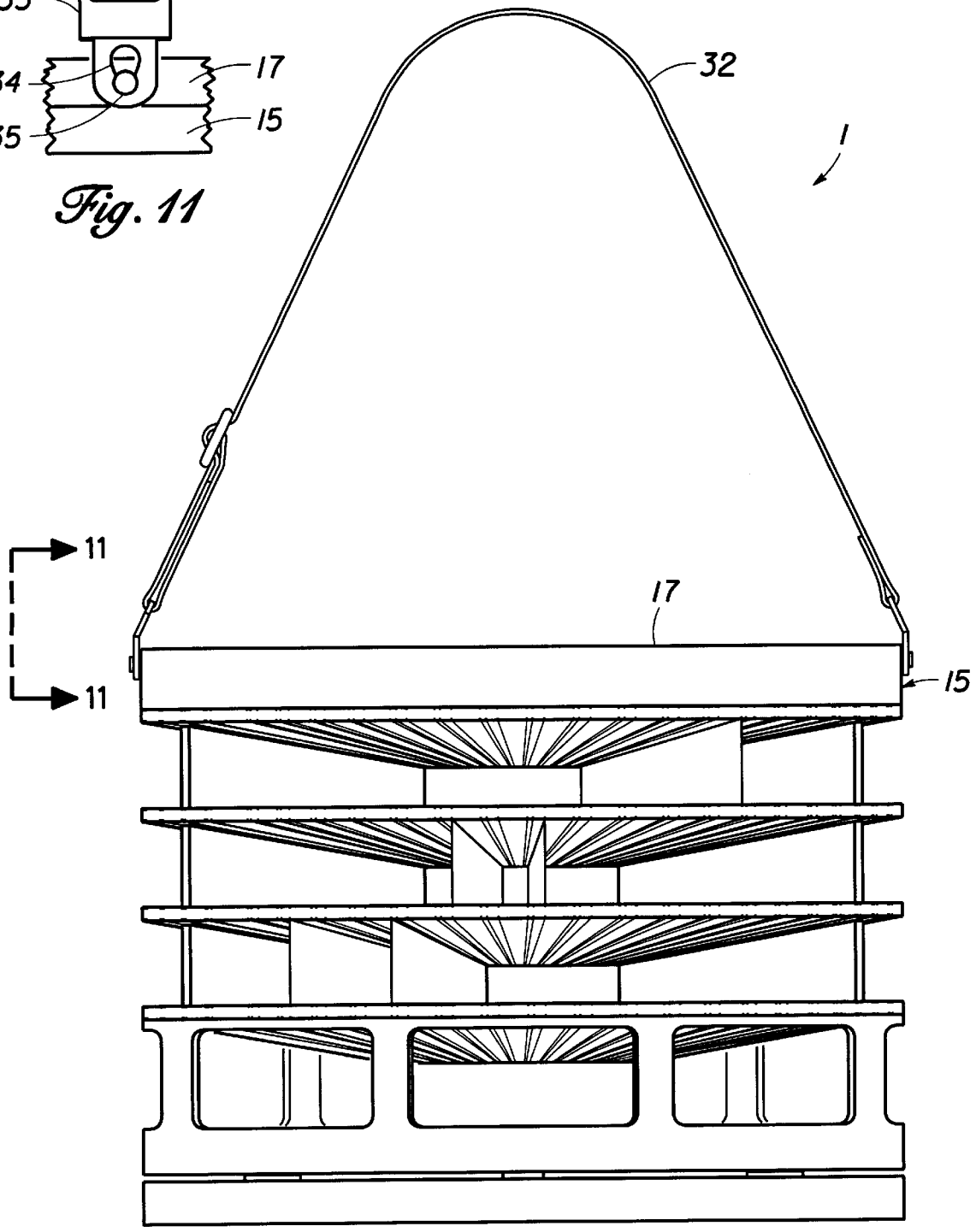
FIG. 10 is a side view of the storage device of the present invention, showing an attached handle for carrying the device.

Adding a handle to the top tier 15, as shown in FIG. 10, would make the storage device 1 easier to move. For instance, an adjustable strap 32, which can be made of leather or vinyl, attaches to the outer surface of raised retaining rim 17 of the top tier 15, at two points 180° apart. As shown in the detail in FIG. 11, each end of the strap 32 has a metal fastening plate 33 with a hole 34 for sliding over a stud 35 which protrudes from the outside of the retaining rim 17 on the top tier 15.

Figure 12:
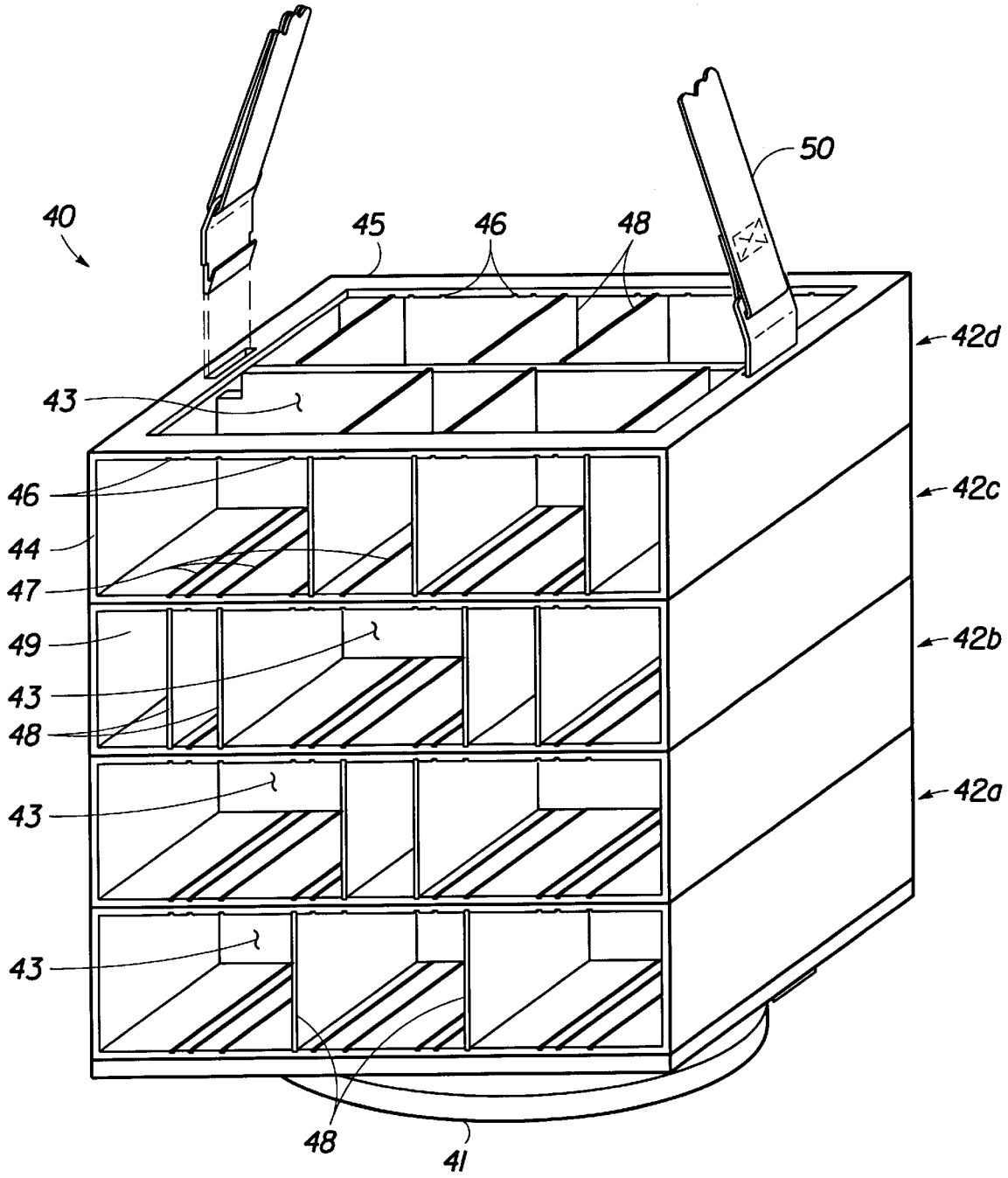
FIG. 12 is an isometric view of an alternate embodiment of the storage device of the present invention, shaped like a cube.
Figure 13:
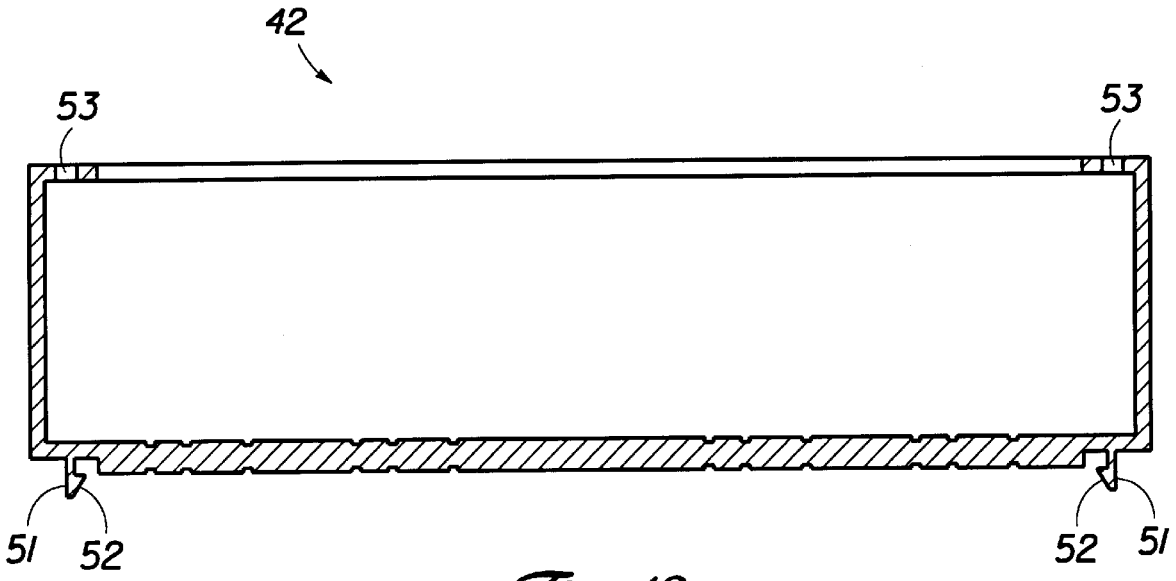
FIG. 13 is a cross-sectional view of a rectangular tier, showing the clips and slots for interlocking two tiers.
Figure 14:
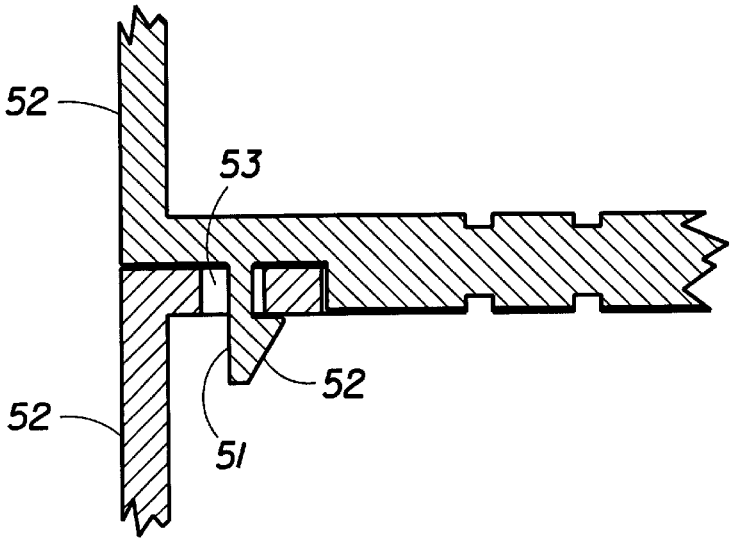
FIG. 14 is a cross-sectional detail of the point at which two rectangular tiers interlock.

A different embodiment of the invention is disclosed in FIGS. 12–14. The storage device 40 is cube-shaped, with circular base 41 which functions the same as base 2. Each rectangular tier 42 has a vertical affixed divider 43, which forms a front face 44 and a back face 45. Access to the back face 45 is gained by rotating the storage device 40 180°. Each divided rectangular tier 42 has horizontal grooves 46, running perpendicular to the affixed dividers 43, on the inside surface of its top side and matching grooves 47 on the inside surface of its bottom side. Rectangular temporary dividers 48 can be inserted into the grooves 46, 47 in order to form appropriately-sized compartments 49 to store different-sized medication bottles (not shown). Ordinarily, several rectangular tiers 42*a*, 42*b*, 42*c*, 42*d* are stacked, one atop the other.

In order to make the storage device portable, a handle 50 is shown attached to the top side of rectangular tier 42*d*. In order to interlock two rectangular tiers 42 as FIG. 13 shows, two clips 51 (or multiples of two) project from the bottom side of each rectangular tier 42, one near each end. Each clip 51 is bendable and has a triangular head 52. In complementary locations on the top side of each rectangular tier 42 are slots for insertion of the clips 51. The triangular head 52 of the clip 51 is inserted through a slot 53 and snaps under top side of the rectangular tier 42 below in order to interlock the two tiers 42, as shown in FIG. 14.

In order to facilitate even greater efficiency in use of the storage devices 1, 40 described herein, various organizational schemes can be implemented. For instance, both the affixed dividers 11, 43 and the temporary dividers 12, 48 can be color-coded to make sections of the tiers 9, 15, 42 readily recognizable, thereby reducing the chance of replacing medication containers in the wrong spot. Using such color-coding, students might learn to recognize the location of their medications and help nurse substitutes locate them more quickly. For medications administered to a student several times a day, a nurse may retrieve a container from one color-coded section or tier, and replace it in another after administering a dose, thereby reducing the risk of having a student miss a dose or take an extra dose.

While the storage devices 1, 40 described herein are used for medication containers, those skilled in the art will recognize their usefulness in providing storage solutions for other applications, such as first aid supplies, beauty products, sewing notions, or kitchen condiments.

I claim:

1. A rotatable, cylindrical device for storing medication containers, the device comprising:

(a) a circular stationary base member having a horizontal surface;

(b) a circular adapter member having a flat bottom and a circular central receiving portion;

(c) means for connecting the base member to the adapter member;

(d) means for enabling said adapter member to rotate about a longitudinal axis, said means affixed to the surface of the base member;

(e) a plurality of stacked tiers, each comprising:

(1) a disk-shaped plate member with a top surface and a bottom surface, the plate member having a circular central opening;

(2) at least three rectangular vertical permanent dividers, each having a lower edge permanently affixed to the upper surface of the plate member along a radius so that each is disposed equidistant from another permanent divider, each of the permanent dividers further having a surface with a boss;

(3) an alignment cylinder affixed to the bottom surface of the plate member, said cylinder having an open upper end and a lower end sized for insertion through the central opening and into the alignment cylinder of another plate member, said alignment cylinder further having at least three L-shaped grooves, each of the L-shaped grooves disposed for receiving the boss on the surface of one of the permanent dividers;

the plurality of tiers being arranged with the alignment cylinder of the lowermost plate member being inserted into the receiving portion of the adapter member, and with each of the other tiers having the alignment cylinder of the plate member being inserted through the central opening and into the alignment cylinder of the plate member directly below said tier.

2. The device of claim 1 which further comprises:

(f) a plurality of rectangular vertical removable dividers, each having an upper edge and a lower edge, and wherein each disk-shaped plate member has a plurality of radial grooves on the top surface and a plurality of radial grooves on the bottom surface, each of said grooves arranged for slidably receiving an edge of one of the plurality of rectangular vertical removeable dividers.

3. The device of claim 1 which further comprises:

(g) a rimmed disk-shape plate member with a bottom surface and with an alignment cylinder affixed to the bottom surface of the rimmed disk-shaped plate member, said rimmed disk-shaped plate member being arranged with the alignment cylinder being inserted through the central opening and into the alignment cylinder of the plate member of the uppermost tier.

4. The device of claim 3 which further comprises:

(h) a handle; and (i) means for attaching the handle to the rimmed disk-shape plate member.

5. The device of claim 1 in which the top surface of each plurality of disk-shaped plate member is angled to incline radially downward at least 8°, but no more than 45°, from the horizontal.

6. The device of claim 1 wherein the base member, the adapter member, and the plurality of tiers are constructed from a material selected from the group consisting of molded plastic, fiberglass, or metal.

* * * * *